United States Patent [19]

Trefts

[11] Patent Number: 4,616,826

[45] Date of Patent: Oct. 14, 1986

[54] GOLF BALL AND TEE SETTING APPARATUS

[76] Inventor: George M. Trefts, 216-A Eagle Point, Punta Gorda, Fla. 33950

[21] Appl. No.: 725,933

[22] Filed: Apr. 22, 1985

[51] Int. Cl.[4] ..... A63B 57/00

[52] U.S. Cl. ..... 273/32.5

[58] Field of Search ..... 273/32.5, 33, 77 R, 273/162 E; 121/297; 294/19 A

[56] References Cited

U.S. PATENT DOCUMENTS

| | | | |
|---|---|---|---|
| 683,244 | 9/1901 | Boda | 273/33 |
| 1,331,499 | 2/1920 | Hartford | 273/77 R |
| 1,948,284 | 2/1934 | Breitbarth | 273/33 |
| 2,834,629 | 5/1958 | Williams | 294/19 |
| 2,943,856 | 7/1960 | Eimerman | 273/33 |
| 3,186,593 | 6/1965 | Miotke | 221/297 |
| 3,669,427 | 6/1972 | Curtis | 294/19 |
| 3,904,200 | 9/1975 | Jackle | 273/32.5 |
| 4,013,295 | 3/1977 | Baugham | 273/162 E |
| 4,313,604 | 2/1982 | Baxter | 273/32 |
| 4,666,650 | 8/1984 | Roedel | 294/19 A |

*Primary Examiner*—Richard C. Pinkham
*Assistant Examiner*—T. Brown
*Attorney, Agent, or Firm*—Bean, Kauffman & Bean

[57] ABSTRACT

A portable and manually operated golf ball teeing unit is disclosed for use in permitting a golfer to position a golf ball and its supporting tee without bending over. A pair of arms are pivotally mounted at the base of the unit. These arms are spring biased to engage and support a ball on top of a tee. After the tee is pushed into the ground, a hand-operated camming rod pivots the arms against the spring bias to release the ball and tee.

3 Claims, 9 Drawing Figures

GOLF BALL AND TEE SETTING APPARATUS

BACKGROUND OF THE INVENTION

Various devices have been proposed for aiding a golfer to position a ball on a tee without requiring the golfer to bend over or kneel. As by way of example, reference may be made to the disclosures of U.S. Pat. Nos. 683,244; 2,943,856; 3,186,593; 3,904,200; 4,013,295; 4,313,604 and 4,466,650.

Further, certain of these prior aids enable a golfer to position a golf ball on a tee incident to the driving of the tee into the ground, as for example in the case of above mentioned U.S. Pat. Nos. 2,943,856; 3,904,200 and 4,013,295.

SUMMARY OF THE INVENTION

The present invention is directed to a golf ball teeing unit. More particularly, the present invention is directed to an improved golf ball teeing unit, which enables a golfer to properly position a golf ball on a tee, as an incident to driving the tee into the ground.

The present unit is adapted to facilitate manual insertion of a golf ball and tee into the unit, and insertion of the tee into the ground to a selectively controlled depth and subsequent removal of the unit from association with the golf ball and inserted tee without dislodging the golf ball from its position on the tee. An additional feature of the present unit is that it incorporates its own stand, which may be employed to temporarily support the unit while a golfer is engaged in play of the golf ball.

DRAWINGS

The nature and mode of operation of the present invention will now be more fully described in the following detailed description taken with the accompanying drawings wherein.

DETAILED DESCRIPTION

Figures 1, 2, 3, 4, 5, 6, 7, 8, 9:
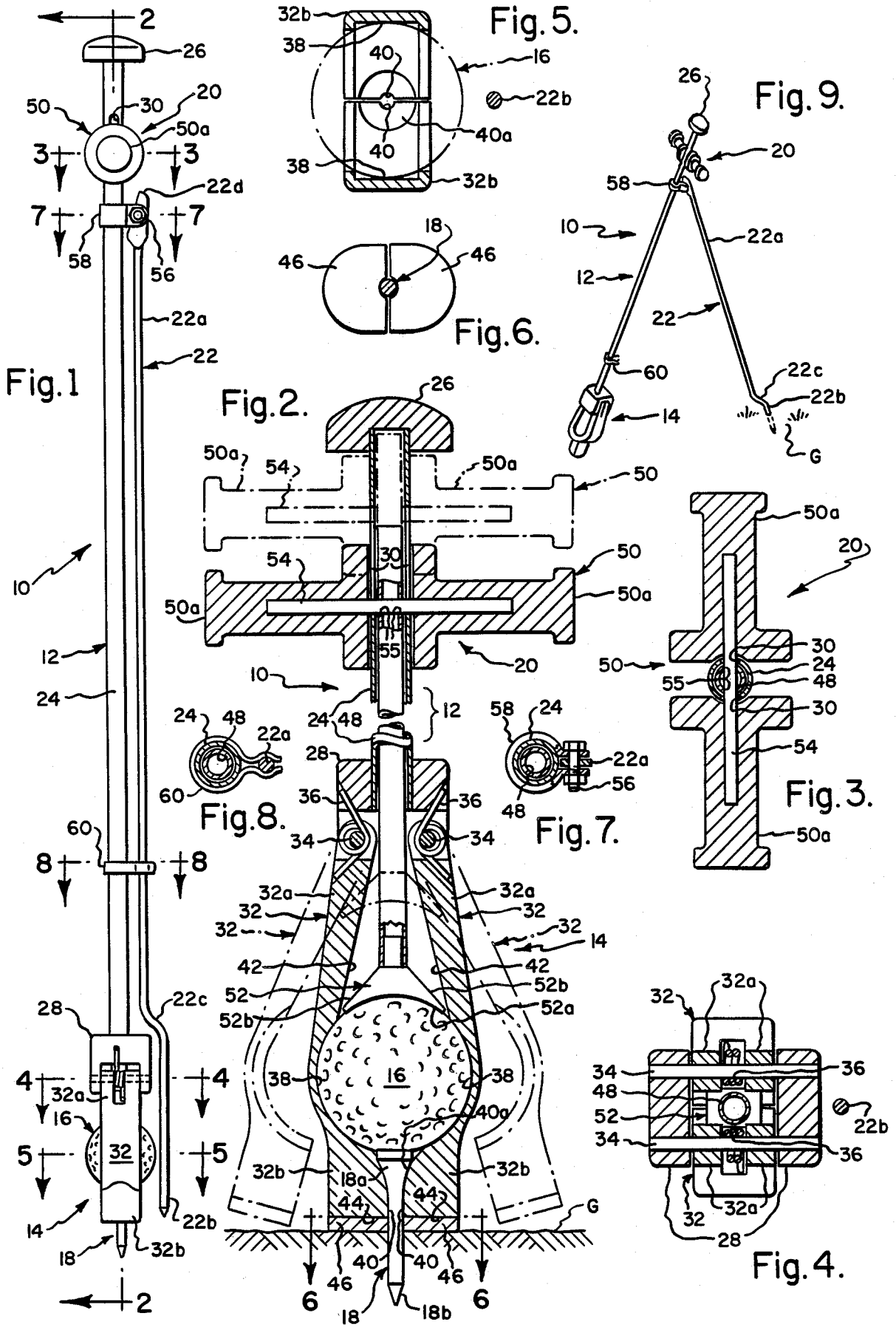
FIG. 1 is a side elevational view of a golf ball teeing unit formed in accordance with a preferred form of the present invention.
FIG. 2 is an enlarged, fragmentary sectional view taken generally along line 2—2 in FIG. 1.
FIG. 3 is an enlarged sectional view taken generally along line 3—3 in FIG. 1.
FIG. 4 is an enlarged sectional view taken generally along line 4—4 in FIG. 1.
FIG. 5 is an enlarged sectional view taken generally along line 5—5 in FIG. 1.
FIG. 6 is a sectional view taken generally along line 6—6 in FIG. 2.
FIG. 7 is an enlarged sectional view taken generally along line 7—7 in FIG. 1.
FIG. 8 is an enlarged sectional view taken generally along line 8—8 in FIG. 1.
FIG. 9 is a reduced size perspective view showing the unit supported by its attached leg.

Reference is first made particularly to FIGS. 1 and 2, wherein the golf ball teeing unit of the present invention is designated as 10 and shown as generally comprising an elongated main frame element 12; a retaining mechanism 14 for releasably retaining a golf ball 16 and a tee 18; a handle or operator mechanism 20; and a supporting leg 22.

Main frame element 12 generally includes a rigid tubular member 24, which has a knob 26 fixed to its upper end, an inverted, generally U-shaped mounting bracket 28 fixed to its lower end, and a pair of aligned, axially extending guide slots 30 formed adjacent its upper end. The axial length of main frame element 12 is chosen to permit a golfer to tee ball 16 in the manner to be described without bending over to any excessive extent.

Retaining mechanism 14 includes a pair of mirror image clamping arms or jaws 32, which have their upper ends 32*a* pivotally mounted on bracket 28 by a pair of parallel pivot pins 34 to provide for pivotal or swinging movements of such arms towards and away from one another between their release and retaining positions shown in broken and full line in FIG. 2. Suitable resilient means, such as shown in FIGS. 1, 2 and 4 as being defined by a pair of coil springs 36 disposed concentrically of pivot pins 34, are employed to normally bias arms 32 into their retaining position. Arms 32 are best shown in FIGS. 2 and 5 as having the facing surfaces of their lower end portions 32*b* shaped to provide a pair of aligned, horizontally and vertically concave recesses 38, which cooperate to removably, partially enclose golf ball 16; and a pair of facing concave and vertically extending, open ended recesses or slots 40, which cooperate to removably, partially enclose tee 18. The open upper ends of recesses 40 are outwardly flared to define a seat 40*a* for removably underengaging the head end 18*a* of tee 18. By again referring to FIG. 2, it will also be understood that facing, generally planar, cam follower surfaces 42 are defined by upper end portions 32*a* and arranged to assume a downwardly divergent relationship; and that generally planar, downwardly facing surfaces 44 are defined by lower end portions 32*b* and arranged to assume an essentially right angular relationship to the axis of tee 18 when arms 32 are disposed in their retaining position. Surfaces 44 serve to define an abutment or stop means limiting the permissive extent of penetration of the pointed end 18*b* of the tee into the ground "G", or in the alternative serve to mount a pair of spacer plates 46 shown in FIGS. 2 and 6, which are in turn intended to serve the same function. Spacer plates 46 may be suitably secured to surfaces 44 by adhesive, or, if desired, by threaded fasteners, not shown. As will be apparent from viewing FIG. 2, the depth of penetration of tee end 18*b* into ground "G", and thus the height of golf ball 16 relative thereto, may be selectively controlled by varying the thickness of spacer plates 46.

Handle mechanism 20 is best shown in FIGS. 2 and 3 as including a rigid tubular operating member 48, which is slidably supported within member 24; a handle 50 fixed to the upper end of the operating member; and a foot or base member 52 fixed to the lower end of the operating member.

Handle 50 includes a pair of handle elements 50*a*, which are fixed in an aligned relationship to the opposite ends of a mounting or guide pin 54, which has its mid-portion arranged to extend through a pair of aligned mounting openings 56 formed in member 48 and to be slidably received within guide slots 30. Abutting engagement of mounting pin 54 with the lower and upper ends of guide slots 30 serves to define the normal or lower and full release or upper positions of handle mechanism 20 shown in full and broken line in FIG. 2, respectively; whereas sliding engagement of such mounting pin with the vertically extending sides of such guide slots serves to prevent relative rotational movement between tubular members 24 and 48.

Foot member 52 is shown in FIG. 2 as having a concave lower or pressure surface 42*a*, which is preferably shaped to generally conform to the contour of golf ball 16; and a pair of generally planar, upper cam surfaces 52*b*, which are arranged in a downwardly diverging relationship and maintained in a facing, aligned relationship one with each of cam follower surfaces 42 by cooperation of mounting pin 54 and guide slots 30. Further, the positioning of the lower ends of guide slots 30 is preferable such as to allow pressure surface 52*a* to rest on or engage with golf ball 16, when unit 10 is arranged in its upstanding position shown in FIGS. 1 and 2 and the handle mechanism is forced to assume its normal position under the influence of gravity.

Now with reference to FIGS. 1, 7 and 9, it will be noted that supporting leg 22 has a straight upper end portion 22a, which is pivotally supported adjacent the upper end of tubular member 24 by suitable means, such as a pivot-clamping bolt 56 and a clamping collar 58; and a straight lower end portion 22*b*, which is preferably pointed or otherwise shaped to facilitate penetration of ground "G". Preferably, end portions 22*a* and 22*b* are connected in a transversely offset relationship by a connecting portion 22*c* in order to permit portions 22*a* and 22*b* to lie closely adjacent the sides of tubular member 24 and retaining mechanism 14, respectively, when leg 22 is disposed in its stored position shown in FIG. 1. Leg 22 may be releasably maintained in its stored position by suitable means, such as may be defined by a snap-fit, generally U-shaped retainer 60, which is formed of resiliently deformable material and arranged to engage about tubular member 24 as best shown in FIG. 8. The upper or free end of leg portion 22*a* extends beyond bolt 56 and defines a stop or projection 22*d* arranged to engage with tubular member 24 for purposes of limiting the extent of pivotal movement of the leg and thus define a temporary support position for unit 10 depicted in FIG. 9.

Operation of unit 10 to effect teeing of a golf ball will now be described with reference being made particularly to FIG. 2 and while assuming that the elements comprising the unit initially lie in their relative positions shown in full line. When a golfer wishes to tee a golf ball, the initial step would be to pull upwardly on handle 50 in order to effect movement thereof relative to main frame element 12 between the normal and release positions of the former. This may be conveniently accomplished by resting knob 12 in the palm of the golfer's hand and then using the tips of the fingers of such hand to underengage handle elements 50*a* and draw same towards the knob. In any event, the resulting movement of handle 50 causes foot 52 to move relatively towards bracket 28 with the result that cam surfaces 52*b* cooperate with cam follower surfaces 42 to cam or effect pivotal movement of arms 32 towards their release position against the return bias of springs 36. With arms 32 temporarily retained in their release position, golf ball 16 and tee 18 may then be inserted by using the golfer's other or free hand. As a practical matter, it is not necessary to pivot arms 32 into their full release position shown in broken line in FIG. 2, since only a relatively small pivot movement is required to move arm lower end portions 32*b* apart sufficiently to permit golf ball 16 and tee 18 to be inserted between the arms in a direction extending transversely of the axis of main frame element 12.

Upon release of handle 50, springs 36 tend to return the elements of unit 10 to their original positions for purposes of retaining golf ball 16 and tee 18 within mechanism 14 in the manner shown in FIG. 2, wherein tee head end 18*a* rests on seat 40*a* with tee pointed end 18*b* projecting outwardly beyond surfaces 44 or spacer plates 46, the golf ball rests on the tee head end and foot 52 rests on the golf ball. It is not necessary for arms 32 and foot 52 to be perfectly sized and shaped, such that surfaces 40 accurately follow and clamp against the sides of tee 18 or that surface 38 and 52*a* accurately follow and clamp against the surface of golf ball 16. Rather, the intent is to constrain tee 18 sufficiently to insure that its axis is maintained essentially aligned with the axis of main frame element 12 and its head end seats within seat 40*a*; to constrain golf ball 16 sufficiently to insure that it is maintained essentially centered relative to and engaged with tee head end 18*a*; and to insure that foot 52 is essentially centered relative to and arranged for enagement with the golf ball.

Thereafter the golfer would manipulate unit 10 for purposes of driving or forcing tee pointed end 18*b* into the ground at a desired location. While this might be accomplished in several ways, it appears most convenient to simply press down on handle 50 until tee 18 has penetrated into the ground a desired distance, such as may be conveniently and automatically determined by engagement of abutment surfaces 44 or spacer plates 46 with the surface of the ground. The golfer would then repeat the initial step described above, but in this instance it is desirable to move handle 50 essentially into its full release position in order to prevent engagement of arms 32 with golf ball 16, as unit 10 is being removed from association therewith, since otherwise the golf ball might be knocked off of tee 18. The golfer need not immediately return unit 10 to a golf bag or lay the unit on the ground for the purpose of freeing his hands before driving. Rather, leg 22 may be pivoted from its normal stored position shown in FIG. 1 and then used to provide a temporary support for unit 10 in an essentially upright manner in the area of the point of play of the golf ball, as generally depicted in FIG. 9.

While unit 10 has been described for use in the teeing of golf balls, it will be understood that it may also be manipulated to permit a golfer to employ arms 32 to pick up golf balls from the ground for purposes of recovery or replacement on a previously positioned tee in the event of dislodging therefrom. Tees may also be picked up from the ground for the purpose of recovery without need for the golfer to bend over.

I claim:

1. A unit for use in teeing a golf ball incident to driving a tee into the ground, said unit comprising in combination:

an elongated main frame element, said frame element includes a tubular member having a U-shaped mounting bracket fixed to its lower end, a knob fixed to its upper end and a pair of aligned, axially extending guide slots formed adjacent its upper end;

a retaining mechanism mounted adjacent a lower end of said main frame element, said mechanism including a pair of arms supported for relative movement between an adjacent retaining position and a remote releasing position, said arms having upper end and lower end portions, said upper end portions are supported by pivot pins bridging between legs of said mounting bracket and have facing cam follower surfaces, said lower end portions define recess means on facing surfaces thereof cooperating when said arms are in said retaining position for retaining a tee to extend generally coaxially with said main frame element with a head end of said tee supported by said arms and a pointed end of said tee projecting outwardly beyond said arms for insertion into the ground and for retaining a golf ball in essentially centered engagement with said head end of said tee, said lower end portions when said arms are in said retaining position limiting the extent of insertion of said pointed end of said tee into the ground by engagement with the ground, said arms when in said release position permitting said tee and golf ball to be removably inserted between said arms, and spring devices surrounding said pivot pins and engaging said arms and said mounting bracket for normally biasing said arms towards said retaining position; and handle mechanism movably carried by said main frame element for controlling movement of said arms between said retaining and releasing positions, said handle mechanism including an operating member slidably received within said tubular member, a handle fixed to an upper end of said operating member by a mounting pin slidably received within said guide slots and a foot fixed to a lower end of said operating member, said foot having a lower surface arranged to engage with said golf ball when retained between said arms for applying pressure thereto for driving said pointed end of said tee into the ground and said foot having cam surfaces arranged to slidably engage with said cam follower surfaces for moving said arms towards said releasing position against the bias of said spring devices, when said foot is moved away from said golf ball and towards said mounting bracket incident to sliding movement of said operating member within said tubular member in a direction towards said knob.

2. A unit according to claim 1, which additionally includes a leg having one end thereof pivotally supported adjacent an upper end of said main frame element for movement between a stored position in which it lies adjacent said main frame element and a unit support position, means for releasably retaining said leg in said stored position and means for limiting the extent of pivotal movement of said leg from said stored position to define said unit support position, said means for limiting movement of said leg is defined by a free end of said one end of said leg arranged to removably abut against said main frame element, said leg having an opposite end shaped to facilitate insertion thereof into the ground upon movement of said leg from said stored position.

3. A unit according to claim 1, wherein plate means are fixed to said lower end portions of said arms to selectively control the extent of insertion of said tee into the ground.

* * * * *

UNITED STATES PATENT AND TRADEMARK OFFICE

CERTIFICATE OF CORRECTION

PATENT NO. : 4,616,826

DATED : October 14, 1986

INVENTOR(S) : George M. Trefts

It is certified that error appears in the above-identified patent and that said Letters Patent are hereby corrected as shown below:

Col. 3, line 2 - "42a" should be -- 52a --;

Col. 4, line 46 - "dislodging" should be -- dislodgement --.

Signed and Sealed this

Seventeenth Day of February, 1987

*Attest:*

DONALD J. QUIGG

*Attesting Officer*

*Commissioner of Patents and Trademarks*